US006710773B2

(12) United States Patent
Jenkins et al.

(10) Patent No.: US 6,710,773 B2
(45) Date of Patent: Mar. 23, 2004

(54) INDUCTORLESS METHOD AND APPARATUS FOR DRIVING ELECTROLUMINESCENT PANELS

(75) Inventors: James Michael Oliver Jenkins, Darms (GB); Jimes Lei, Milpitas, CA (US)

(73) Assignee: Supertex, Inc., Sunnyvale, CA (US)

( * ) Notice: Subject to any disclaimer, the term of this patent is extended or adjusted under 35 U.S.C. 154(b) by 253 days.

(21) Appl. No.: 09/943,435

(22) Filed: Aug. 2, 2001

(65) Prior Publication Data

US 2003/0025691 A1 Feb. 6, 2003

(51) Int. Cl.[7] ..... G09G 5/00

(52) U.S. Cl. ..... 345/211; 345/76; 345/212; 315/169.3; 363/59

(58) Field of Search ..... 315/169.3, 209 R; 363/59–61; 345/76, 211–215

(56) References Cited

U.S. PATENT DOCUMENTS 4,321,661 A * 3/1982 Sano ..... 363/60
4,496,977 A 1/1985 Ikeda ..... 358/148
4,769,753 A 9/1988 Knudson et al. ..... 363/60
5,491,623 A * 2/1996 Jansen ..... 363/60
5,861,719 A 1/1999 Koskowich et al. .... 315/209 R
6,043,610 A 3/2000 Buell ..... 315/169.3
6,232,964 B1 * 5/2001 Lee ..... 345/212

* cited by examiner

*Primary Examiner*—Kent Chang
*Assistant Examiner*—Tom Sheng
(74) *Attorney, Agent, or Firm*—Andrew M. Harris; Jeffrey D. Moy; Weiss, Moy & Harris, P.C.

(57) ABSTRACT

A inductorless method and apparatus for driving electroluminescent (EL) panels enables fabrication of an integrated circuit that provides a complete EL panel driver solution in one package. The high voltage required to drive the EL panel is generated by a plurality of charge pump circuits. A multi-stage charge pump may be used to provide a high voltage power supply that does not require an external capacitor to store energy for the power supply.

13 Claims, 4 Drawing Sheets

INDUCTORLESS METHOD AND APPARATUS FOR DRIVING ELECTROLUMINESCENT PANELS

BACKGROUND OF THE INVENTION

1. Field of the Invention

The present invention relates generally to integrated circuits, and more specifically, to an integrated circuit for implementing a inductorless electroluminescent panel driver.

2. Background of the Invention

Electroluminescent (EL) panels are in common use as backlights for keyboards and displays. Recent uses of EL panels include wrist watches, cellular telephone displays and keyboards, notebook computers and personal digital assistants (PDAs). In order to produce illumination from an EL panel, an alternating high voltage power supply is required. An EL panel driver includes a high voltage power supply, and a mechanism for switching the high voltage power supply output to produce a high voltage output of alternating polarity for connection to the EL panel.

Traditionally, an integrated circuit controlled for implementing an EL panel driver circuit contains an oscillator, a high voltage power supply and a switching circuit coupled to the oscillator and the high voltage power supply for creating the alternating high voltage output for connection to the EL panel.

The high voltage power supply in an integrated circuit EL panel driver typically includes connections for either an inductor or a transformer to convert a low voltage input power supply to a high voltage that is then coupled to one or more terminals of the integrated circuit, which include a flyback switch transistor terminal and a terminal for coupling the high voltage DC output to the switching circuit that alternates the voltage supplied to the EL panel.

With the high density integration requirements present in devices such as cellular telephones and notebook computers, and in devices having very small packages such as wristwatches, it is desirable to produce a single integrated circuit solution with a minimum of external components and terminals. However, it is impractical to incorporate inductors or transformers within an integrated circuit package.

Therefore, it would be desirable to provide a inductorless apparatus and method for driving EL panels that may be incorporated within a single integrated circuit package.

SUMMARY OF THE INVENTION

The above objective of providing a inductorless apparatus and method for driving EL panels is accomplished in an integrated circuit including a high voltage power supply and a switching circuit for producing an alternating high voltage output from the high voltage power supply. The high voltage power supply includes a plurality of charge pump circuits for generating the high voltage power supply output. The high voltage power supply may also include a multi-stage charge pump to reduce voltage loss associated with driving charge pump circuits from a low voltage power supply, which results in a lesser number of overall charge pumps required to achieve a the voltage level required to drive the EL panel.

The foregoing and other objectives, features, and advantages of the invention will be apparent from the following, more particular, description of the preferred embodiment of the invention, as illustrated in the accompanying drawings.

DETAILED DESCRIPTION OF THE PREFERRED EMBODIMENTS

Figure 1:
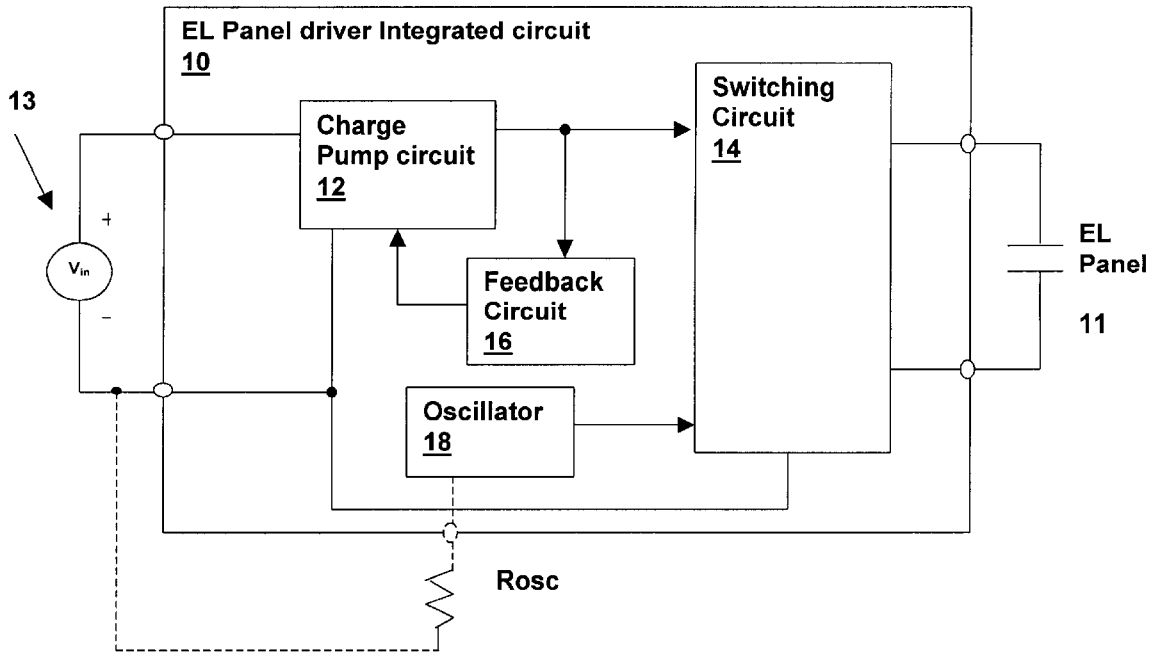
FIG. 1 is a schematic diagram depicting an integrated circuit in accordance with a preferred embodiment of the present invention.

Referring now to the figures and in particular to FIG. 1, an integrated circuit in accordance with a preferred embodiment of the invention is shown. An electroluminscent (EL) panel driver integrated circuit 10 is coupled to EL panel 11 via two terminal connections. The terminal connections have an alternating high voltage DC output (for example +/−80V) that causes the EL panel to luminesce. An input voltage supply 13 provides the operating power for integrated circuit 10 and through integrated circuit 10, the power to operate EL panel 11. Input voltage supply 13 is coupled to integrated circuit 10 through two terminal connections. Thus, integrated circuit 10 requires only four terminals to interface to all external circuitry and does not require a transformer or inductor as needed in prior art circuits.

Integrated circuit 10 achieves inductorless operation through use of a charge pump circuit 12 that includes a plurality of charge pumps to generate a high voltage DC output provided to a switching circuit 14 that alternates the high voltage DC output of charge pump circuit 12 to produce a high voltage AC signal for driving EL panel 11. Switching circuit 14 is coupled to an oscillator 18 that provides a switching signal to switching circuit 14. An optional terminal coupled to oscillator 18 provides for frequency adjustment, which will affect the "hue" of EL panel 11. A resistor Rosc may be connected to an internal RC oscillator within oscillator 18 or an external clock, such as a programmable clock from a notebook computer internal port pin may be supplied. It should be noted that this additional terminal connection is not required for operation of integrated circuit 10, but is an optional feature.

The high voltage DC output of charge pump circuit 12 is controlled by a feedback circuit 16 that disables charge pump circuit 12 when a predetermined voltage level is generated at the output of charge pump circuit 12, thus regulating the voltage supplied to switching circuit 14 and controlling the amplitude of the AC high voltage drive signal supplied to EL panel 11.

Figure 2:
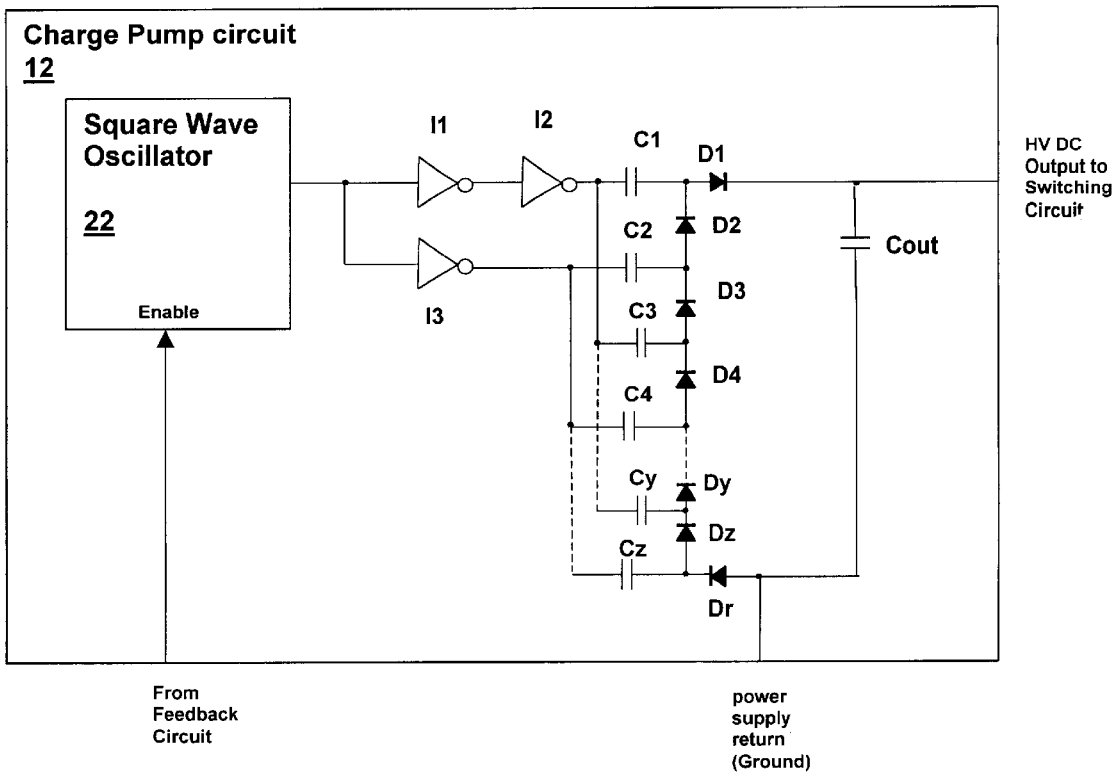
FIG. 2 is a schematic diagram depicting details of charge pump circuit 12 of FIG. 1.

Referring now to FIG. 2, details of charge pump circuit 12 are shown. A square wave oscillator 22 produces a switching signal within charge pump circuit 12. The switching signal is split into a first phase by the inverter chain formed by inverters I1 and I2 and a second phase by inverter I3. Square wave oscillator 22 also receives an enable signal from feedback circuit 16 that disables oscillator 22 when the output of charge pump circuit 12 reaches a predetermined high voltage level. Oscillator 22 is disabled until the output of charge pump circuit 12 falls below the predetermined high voltage level, thus providing regulation of the output of charge pump circuit 12.

A stacked capacitor-diode chain is used to generate the high voltage output from charge pump circuit 12. The capacitors and diodes form a plurality of charge pumps within charge pump circuit 12 and the number of charge pumps that are stacked is determined by the input voltage, the desired output voltage and the losses due to the diode drops and ESR of the capacitors.

The charge pump circuit functions as follows: During the first oscillator phase transition, the leftmost terminals of the odd-numbered capacitors will be at a logic low voltage level and transition to a logic high voltage level. At the transition, capacitor C1 will charge capacitor Cout through diode D1 and capacitor C2 will be discharged to within a voltage drop of the voltage at the anode of diode D2. When the output of square wave oscillator 22 transitions to a logic low voltage level, capacitor C1 will be charged through diode D2. As the switching action generated by square wave oscillator 22 continues, Cout will be charged to a multiple of the input power supply voltage less a number of diode voltage drops. The voltage is determined by the numbed of stacked charge pump stages. In the figure, the stacked stages are illustrated by a first stage comprising capacitors C1 and C2 along with diodes D1 and D2, a second stage comprising capacitors C3 and C4 along with diodes D3 and D4, and a final stage comprising capacitors Cy and Cz along with diodes Dy, Dz and Dr. Any number of charge pump stages may be inserted between the second charge pump stage and the final charge pump stage as illustrated in the figure by the dashed connections.

The resulting voltage across capacitor Cout after many switching cycles will be the input power supply voltage multiplied by the number of charge pump stages, less a number of voltage drops equal to two plus the number of charge pump stages (the total number of diodes in the stacked charge pump ladder). Thus, for an 80V supply generated from a 3V input, and assuming a 0.5V diode drop, at least 32 charge pump stages are required in the stack. As the number of stages are increased, the drive capabilities of inverters I2 and I3 must be correspondingly increased and the voltage ratings of the capacitors in the charge pumps need to be increased to handle the higher voltages present in the stack.

Figure 3:
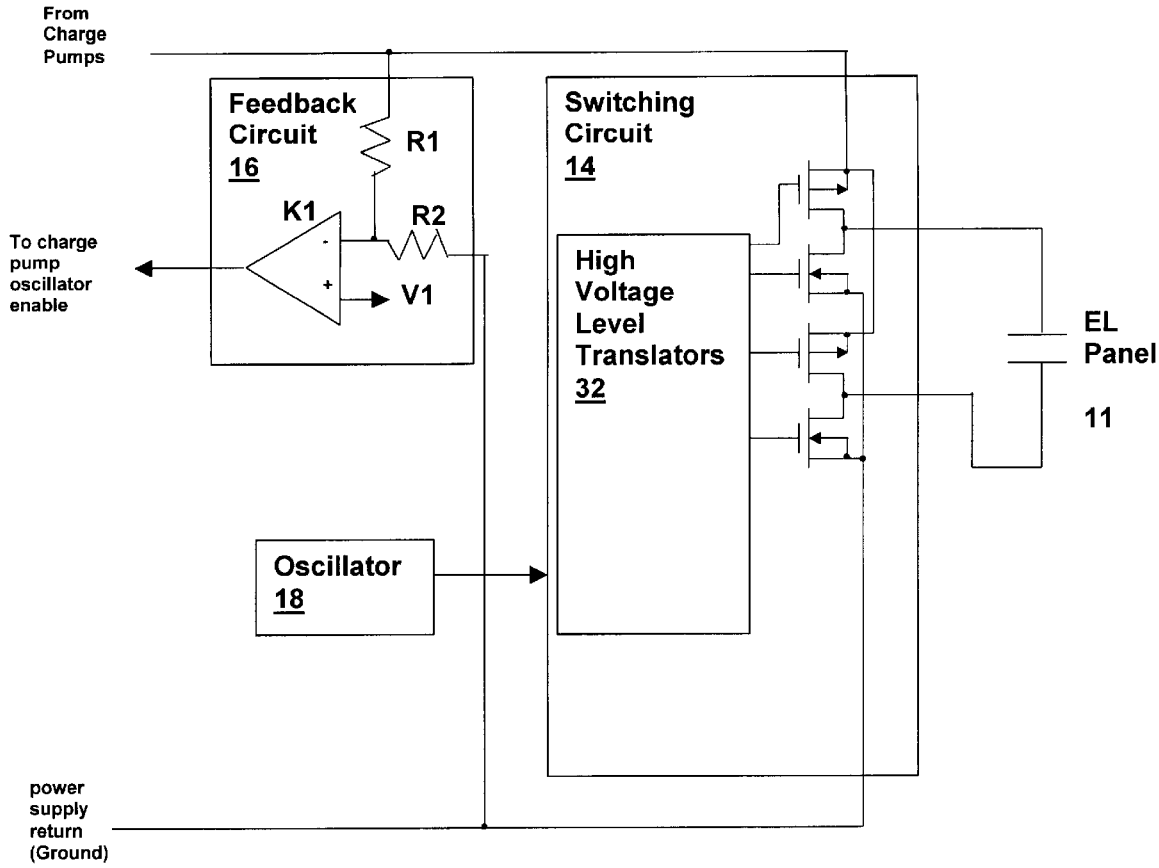
FIG. 3 is a schematic diagram depicting details of the integrated circuit of FIG. 1.

Referring now to FIG. 3, details of integrated circuit 10 of FIG. 1 are shown. Switching circuit 14 incorporates a full bridge formed by MOSFET transistors N1, N2, P1, and P2. High voltage level translators 32 provide the drive voltages for the gates of transistors N1, N2, P1, and P2 so that N1 and P2 are enabled for one phase of oscillator 18 and transistors N2 and P1 are enabled for the alternate phase, producing an alternating high voltage output across EL panel 11. Additional circuitry may be incorporated within switching circuit 14 to eliminate switching overlap, or to provide discharge time between enabling the transistor pairs so that a doubled EL panel voltage does not appear across the transistor pairs in the full bridge circuit.

Feedback circuit 16 includes a comparator K1 that compares a reference voltage V1 to a voltage generated from the high voltage DC output of charge pump circuit 12 by the resistor divider comprising resistors R1 and R2. The output of comparator K2 is provided to charge pump circuit 12 to disable oscillator 22, regulating the output of charge pump circuit 12.

Figure 4:
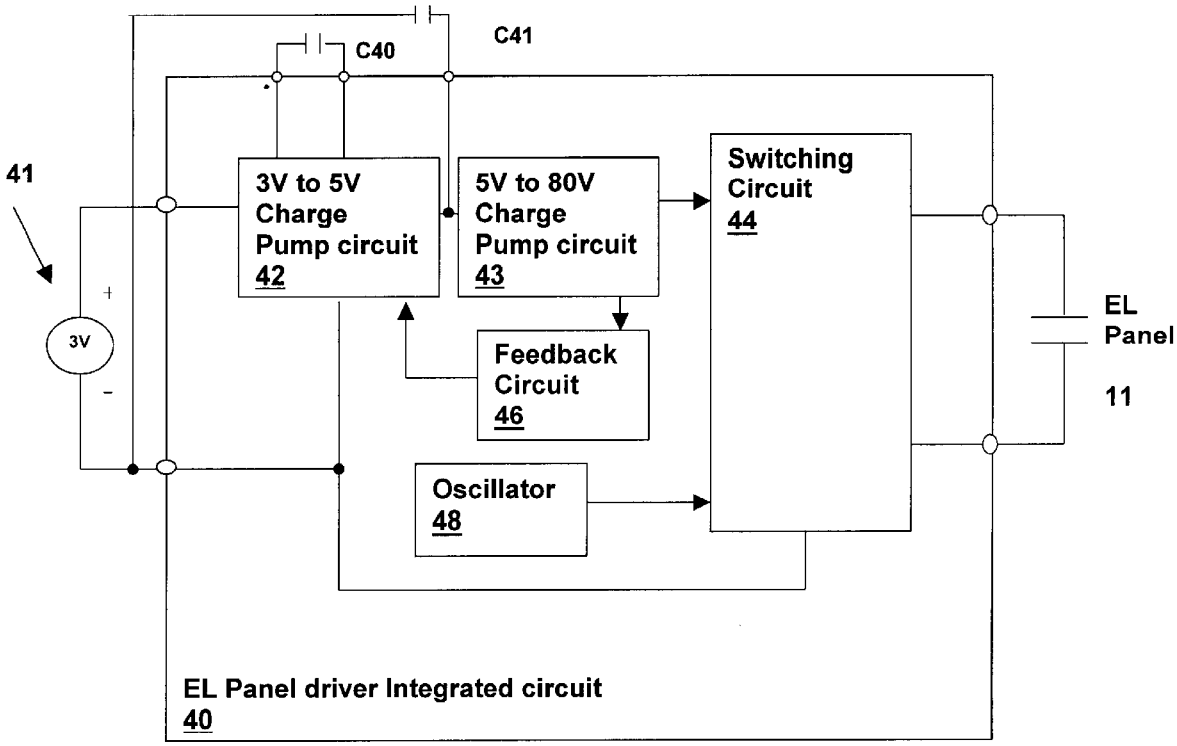
FIG. 4 is a schematic diagram depicting an integrated circuit in accordance with an alternative preferred embodiment of the invention.

Referring now to FIG. 4, an integrated circuit in accordance with an alternative embodiment of the invention is depicted. In the alternative embodiment, performance of the charge pump circuit is improved by using two cascaded charge pump circuits. A 3V to 5V charge pump circuit 42 is coupled to input voltage source 41, which supplies a 3V input voltage. Charge pump circuit 42 uses an external capacitor C40, which must be larger than the capacitors of FIG. 2 as it stores and transfers a larger charge. An external capacitor C41 on the output of charge pump circuit 42 is also used to hold the output voltage of charge pump circuit 42 which is approximately 5V. Transistors may be used rather than diodes in charge pump circuit 42, providing a lower voltage drop which is more critical in the conversion from 3V to 5V than the diode drops in a higher voltage converter.

A 5V to 80V charge pump circuit 43, which may be constructed in a manner consistent with the charge pump circuit of FIG. 2, converts the 5V output from charge pump 42 to an 80V output. A feedback circuit 46 is coupled to charge pump 42 and charge pump 43 to halt their operation when the output voltage of charge pump 43 has reached the predetermined high voltage output level. Switching circuit 44 alternates the polarity of the output of charge pump 43 to produce the AC drive signal for EL panel 11 and oscillator 48 provides switching signals to control switching circuit 44.

The alternative embodiment of FIG. 4 is preferred for an efficient design at input voltages below 5V, but since it requires external capacitors and consequent additional terminals for external connection, it is not preferred from a packaging standpoint.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. An integrated circuit for supplying a drive voltage to an electroluminescent (EL) panel, comprising:

an output terminal for connection to said EL panel;

a high voltage power supply for producing a DC output, said high voltage power supply including plurality of charge pump circuits; and a switching circuit coupled to said output terminal for alternating said DC output at said output terminal;

wherein said plurality of charge pump circuits comprise:

a first diode coupled to a first output of said charge pump circuit for preventing discharge of said first output;

a first capacitor having a first terminal coupled to a first phase of a clock input and further having a second terminal coupled to said first diode for charging said output through said first diode;

a second capacitor having a first terminal coupled to a second phase of a clock input and further having a second terminal coupled to a second output of said charge pump circuit for discharging said second output; and a second diode coupled to said second terminal of said second capacitor and further couple to said second terminal of said first capacitor.

2. The integrated circuit of claim 1, further comprising an oscillator coupled to said high voltage power supply for controlling switching of said plurality of charge pump circuits.

3. The integrated circuit of claim 2, wherein said integrated circuit has exactly five external terminals comprising:

a first terminal for connection to a first terminal of said EL panel;

a second terminal for connection to a second terminal of said EL panel;

a third terminal for connection to an input power supply;

a fourth terminal for connection to an input power supply return; and a fifth terminal coupled to said oscillator for connection to a frequency adjusting component.

4. The integrated circuit of claim 3, further comprising an oscillator and wherein said frequency adjusting component is a resistor for adjusting a frequency of said oscillator.

5. The integrated circuit of claim 1, regarding said plurality of charge pump circuits wherein said first diode, said first capacitor, said second diode, and said second capacitor form a first charge pump circuit cascaded in series with a second charge pump circuit and so on.

6. The integrated circuit of claim 5, wherein said first charge pump circuit generates a first voltage that is approximately twice an input voltage of said integrated circuit, and wherein said second charge pump circuit comprises a plurality of stacked switched capacitor circuits for producing said DC output from said first voltage.

7. The integrated circuit of claim 6, wherein said first charge pump circuit comprises a switched transistor voltage doubler.

8. The integrated circuit of claim 1, further comprising a feedback circuit coupled to plurality of charge pump circuits that disables the plurality of charge pump circuits when a predetermined voltage level is generated.

9. The integrated circuit of claim 1, wherein said integrated circuit has exactly four external terminals comprising:

a first terminal for connection to a first terminal of said EL panel;

a second terminal for connection to a second terminal of said EL panel;

a third terminal for connection to an input power supply; and a fourth terminal for connection to an input power supply return.

10. The integrated circuit of claim 1, wherein said switching circuit comprises a full bridge transistor circuit for switching said DC output alternatively with ground to said output terminal.

11. A method for driving an electroluminescent (EL) panel, said method comprising:

providing an integrated circuit for supplying a drive voltage to said electroluminescent (EL) panel, comprising:

an output terminal for connection to said EL panel;

a high voltage power supply for producing a DC output, said high voltage power supply including plurality of charge pump circuits; and a switching circuit coupled to said output terminal for alternating said DC output at said output terminal;

wherein said plurality of charge pump circuits comprise:

a first diode coupled to a first output of said charge pump circuit for preventing discharge of said first output;

a first capacitor having a first terminal coupled to a first phase of a clock input and further having a second terminal coupled to said first diode for charging said output through said first diode;

a second capacitor having a first terminal coupled to a second phase of a clock input and further having a second terminal coupled to a second output of said charge pump circuit for discharging said second output; and a second diode coupled to said second terminal of said second capacitor and further coupled to said second terminal of said first capacitor;

charging said first and second capacitors with a supply voltage;

connecting said first and second capacitors in series to produce a high voltage; and supplying said high voltage to said EL panel.

12. The method of claim 11, further comprising doubling an input supply voltage to produce said supply voltage for said charging.

13. The method of claim 11, further comprising switching said high voltage to produce an alternating high voltage to said EL panel.

* * * * *